US006658345B2

(12) United States Patent
Miller

(10) Patent No.: US 6,658,345 B2
(45) Date of Patent: Dec. 2, 2003

(54) TEMPERATURE COMPENSATION SYSTEM FOR MINIMIZING SENSOR OFFSET VARIATIONS

(75) Inventor: Paul R. Miller, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 354 days.

(21) Appl. No.: 09/861,341

(22) Filed: May 18, 2001

(65) Prior Publication Data

US 2002/0173899 A1 Nov. 21, 2002

(51) Int. Cl.[7] ..... F02M 25/07

(52) U.S. Cl. ..... 701/108; 701/115; 123/568.12; 123/41.31

(58) Field of Search ..... 701/108, 113, 701/102, 115; 123/568.12, 568.16, 491, 480, 41.05, 41.01, 41.15, 41.31; 73/118.2, 117.3; 60/274, 284

(56) References Cited

U.S. PATENT DOCUMENTS

| | | | | | |
|---|---|---|---|---|---|
| 5,190,017 | A | | 3/1993 | Cullen et al. | 123/676 |
| 5,209,212 | A | | 5/1993 | Viess et al. | 123/568.16 |
| 5,243,949 | A | | 9/1993 | Osawa | 123/676 |
| 5,309,887 | A | | 5/1994 | Kondo et al. | 123/568.16 |
| 5,337,725 | A | | 8/1994 | Narita | 123/568.16 |
| 5,341,300 | A | | 8/1994 | Fujimoto | 701/108 |
| 5,349,936 | A | | 9/1994 | Uchinami | 123/676 |
| 5,388,404 | A | * | 2/1995 | Tsumura | 60/284 |
| 5,474,051 | A | | 12/1995 | Matsumoto et al. | 123/568.16 |
| 5,505,165 | A | * | 4/1996 | Kimoto | 123/41.31 |
| 5,508,926 | A | | 4/1996 | Wade | 701/29 |
| 5,529,041 | A | * | 6/1996 | Andrews | 73/117.3 |
| 5,621,167 | A | | 4/1997 | Fang-Cheng | 73/118.1 |
| 5,635,633 | A | | 6/1997 | Kadota | 73/118.1 |
| 5,675,080 | A | | 10/1997 | Wada | 73/118.1 |
| 5,727,533 | A | | 3/1998 | Bidner et al. | 123/568.16 |
| 5,934,249 | A | | 8/1999 | Nanba et al. | 123/350 |
| 5,964,820 | A | | 10/1999 | Miwa et al. | 701/108 |

FOREIGN PATENT DOCUMENTS

| | | | | |
|---|---|---|---|---|
| JP | 1-159465 | * | 6/1989 | F02N/17/08 |

* cited by examiner

*Primary Examiner*—Hieu T. Vo
(74) *Attorney, Agent, or Firm*—Barnes & Thornburg

(57) ABSTRACT

A temperature compensation system for minimizing sensor offset variations includes an engine controller having stored therein a model of sensor operating behavior over temperature. In one embodiment, the sensor is a ΔP sensor for sensing a differential pressure across a flow restriction mechanism disposed between an exhaust manifold and an intake manifold of an internal combustion engine. In this embodiment, the ΔP sensor is preferably thermally coupled to a structural component of the engine whose operating temperature is readily discernable; e.g., the engine cooling system. Alternatively, the ΔP sensor may include a temperature sensor coupled thereto. In either case, the engine controller is preferably responsive to transitions of the key switch to gather "hot" and "cold" temperature data under zero ΔP conditions. This information is then used to constantly update the ΔP sensor model.

28 Claims, 5 Drawing Sheets

TEMPERATURE COMPENSATION SYSTEM FOR MINIMIZING SENSOR OFFSET VARIATIONS

FIELD OF THE INVENTION

The present invention relates generally to temperature compensation systems, and more specifically to temperature compensation systems for minimizing offset variations in a sensor sensing an operating condition of an internal combustion engine.

BACKGROUND OF THE INVENTION

Modern electronic control systems for internal combustion engines include a number of sensors and/or sensing systems for determining various engine operating conditions. Many of these sensors are located in harsh environments and are subjected to widely varying operating conditions throughout their lives. Despite potentially harsh operating conditions, however, such sensors are typically required to produce consistent results over their entire operating range.

An example of one varying environmental condition that many engine operating condition sensors are subject to is temperature. Typically, many engine operating condition sensors are required to operate consistently over a wide temperature range that may include temperatures as low as −40° C. and as high as 150° C. While some engine operating condition sensors tend to operate substantially consistently over a required operating temperature ranges, others do not, Even with those that do not, performance specifications of some such sensors may allow for wide variations in sensor operation over temperature, and in such cases, temperature compensation of the resultant sensor signal is typically not warranted.

One solution to the problem of varying sensor operation over temperature is to design the sensor to be robust over temperature and therefore less susceptible to temperature fluctuations. This, however, is typically a costly solution, and designers of engine control systems have accordingly opted for less costly solutions such as temperature compensation of the raw sensor signal. Although typically less costly, conventional temperature compensation schemes for engine operating condition sensors have their own drawbacks. For example, the sensor may exhibit a complicated temperature response that is difficult to model or to counteract with temperature compensation circuitry. Further, the sensor temperature response may vary widely from sensor to sensor. Further still, only a portion of the sensor signal; i.e., either a sensitivity (signal gain) term or a DC offset term, may be susceptible to temperature-induced variations while other portions of the signal are substantially temperature independent. What is therefore needed is a temperature compensation system for minimizing sensor signal variations that addresses these and other drawbacks associated with known sensor compensation strategies.

SUMMARY OF THE INVENTION

The foregoing shortcomings of the prior art are addressed by the present invention. In accordance with one aspect of the present invention, a temperature compensation system for minimizing sensor offset variations comprising: a sensor producing a sensor signal indicative of an operating condition of an internal combustion engine, means for determining a temperature of said sensor and producing a temperature signal corresponding thereto, a key switch for starting and stopping said engine, said key switch having at least an on position and an off position, and an engine controller responsive to a transition of said key switch to said on position to determine a first temperature signal value and an associated first sensor signal value, said controller responsive to a transition of said key switch to said off position to determine a second temperature signal value and an associated second sensor signal value, said controller defining an offset value associated with said sensor as a function of said first and second temperature signal values and of said first and second sensor signal values.

In accordance with another aspect of the present invention, a temperature compensation system for minimizing sensor offset variations comprises a sensor producing a sensor signal indicative of an operating condition of an internal combustion engine, a memory having stored therein a model of said operating condition, said model defining a temperature dependent offset term, means for determining a temperature of said sensor and producing a temperature signal corresponding thereto, a key switch for starting and stopping said engine, said key switch having at least an on position and an off position, and an engine controller monitoring said key switch, said controller responsive to said temperature signal and said sensor signal to determine a first temperature and a first signal value associated with said sensor if said key switch switches to either of said off and on positions, said controller updating said temperature dependent offset term based on said first temperature and said first signal value.

In accordance with a further aspect of the present invention, a temperature compensation method of minimizing sensor offset variations comprises the steps of sensing an operating condition of an internal combustion engine with an engine operating condition sensor, computing a value of said engine operating condition based on a model defining a response of said engine operating condition sensor, said model including a temperature dependent offset term, monitoring a key switch for starting and stopping said engine, determining a first operating temperature of said engine operating condition sensor and an associated first sensor value if said key switch switches to either of an off and an on position thereof, and updating said offset term of said model based on said first operating temperature and said first sensor value.

One object of the present invention is to provide a temperature compensation system for minimizing variations in a sensor offset parameter.

Another object of the present invention is to provide such a system for temperature compensating an offset term of an engine operating condition sensor.

A further object of the present invention is to provide such a system for temperature compensating an offset term of a differential pressure sensor in particular, wherein the sensor is disposed across a flow restriction mechanism disposed between an exhaust manifold and an intake manifold of the engine.

These and other objects of the present invention will become more apparent from the following description of the preferred embodiments.

DESCRIPTION OF THE PREFERRED EMBODIMENTS

Figure 1:
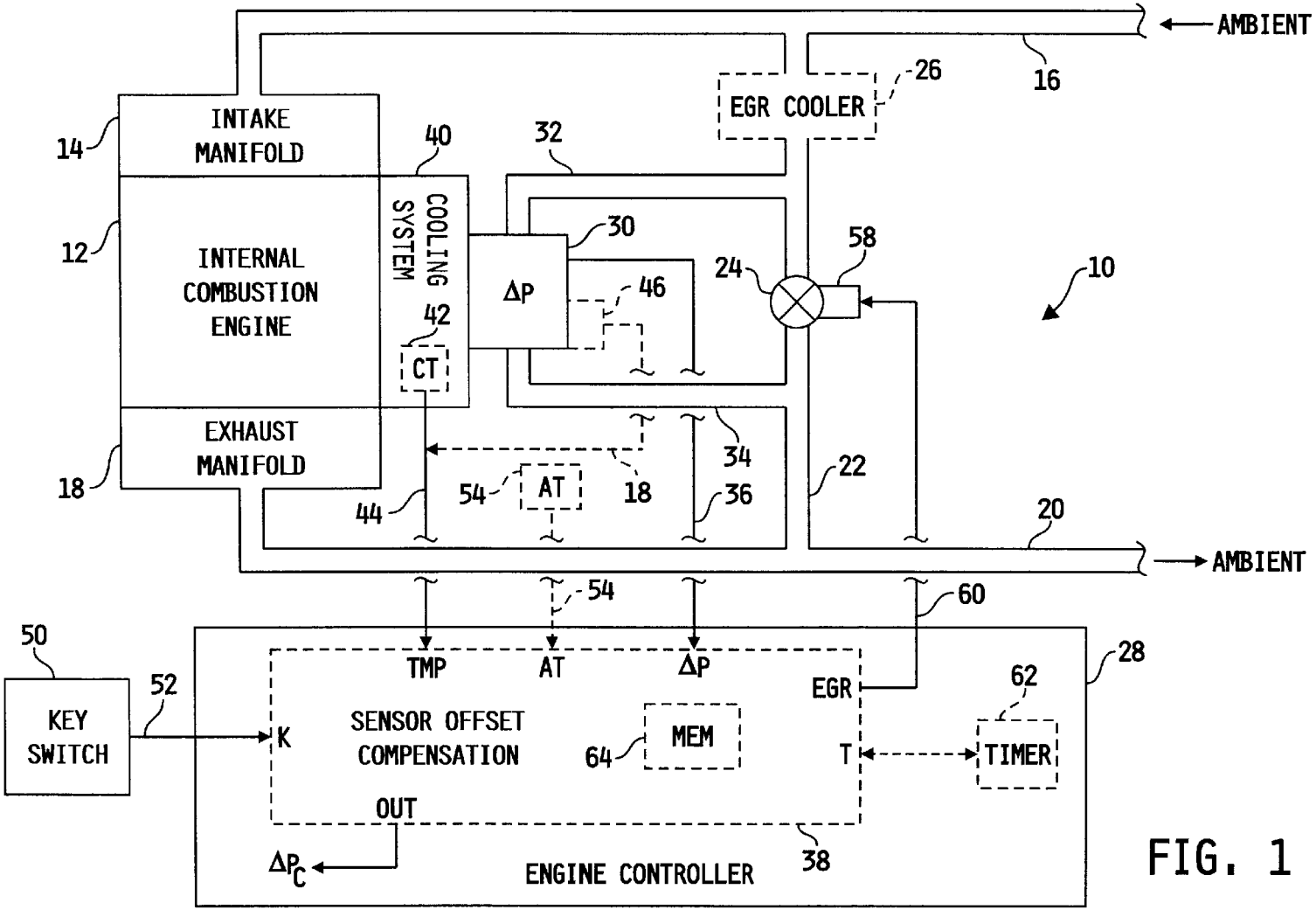
FIG. 1 is a diagrammatic illustration of one preferred embodiment of a temperature compensation system for minimizing sensor offset variations, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, one preferred embodiment of a temperature compensation system 10 for minimizing sensor offset variations, in accordance with the present invention, is shown. System 10 includes an internal combustion engine 12 having an intake manifold 14 fluidly coupled to ambient via intake conduit 16. An exhaust manifold 18 is fluidly coupled to ambient via exhaust manifold 20, and an exhaust gas recirculation (EGR) conduit 22 has a first end fluidly coupled to the exhaust manifold 18 and a second end fluidly coupled to the intake manifold 14. EGR conduit 22 preferably includes a flow restriction mechanism 24 disposed in line therewith, and may optionally include an EGR cooler 26 disposed between the flow restriction mechanism 24 and the intake manifold 14, as shown in phantom, for cooling the exhaust gas supplied to intake manifold 14. System 10 may further include other air handling components (not shown) that are commonly known and used in the automotive and diesel engine industries including, but not limited to, a turbocharger, wastegate and/or exhaust throttle.

Central to system 10 is an engine controller 28 that is preferably microprocessor-based and is generally operable to control and manage the overall operation of engine 12. Engine controller 28 includes a memory unit 64 as well as a number of inputs and outputs for interfacing with various sensors and systems coupled to engine 12. Controller 28, in one embodiment, may be a known control unit sometimes referred to as an electronic or engine control module (ECM), electronic or engine control unit (ECU) or the like, or may alternatively be a general control circuit capable of operation as described hereinafter.

In accordance with the present invention, engine controller 28 includes a sensor offset compensation block 38 receiving a number of inputs from various sensors and/or control mechanisms associated with the operation of internal combustion engine 12. For example, system 10 includes a differential pressure sensor (so-called ΔP sensor) 30 having one end fluidly coupled to the EGR conduit 22 downstream of the flow restriction mechanism 24 via conduit 32, and an opposite end fluidly coupled to EGR conduit 22 upstream of flow restriction mechanism 24 via conduit 34. Sensor 30 is electrically connected to a ΔP input of sensor offset compensation block 38 via signal path 36, wherein sensor 30 is operable to supply compensation block 38 with a signal indicative of a pressure difference across flow restriction mechanism 24. It is to be understood that although FIG. 1 is illustrated as including a temperature compensation strategy for minimizing temperature variations in a ΔP sensor signal, the present invention contemplates that the sensor 30 may alternatively be another engine operating condition sensor for which temperature compensation of the sensor signal is desired. Those skilled in the art will recognize known engine operating condition sensors wherein it would be desirable to temperature compensate signals produced thereby, and such other engine operating condition sensors are intended to fall within the scope of the present invention. While temperature compensation of such other sensors is contemplated, however, the following description will be limited to a ΔP sensor 30 for brevity.

In accordance with one aspect of the present invention, the operating temperature of ΔP sensor 30 is preferably determined by thermally coupling sensor 30 to a structural component of engine 12 having a known or readily ascertainable operating temperature. In one preferred embodiment, as shown by example in FIG. 1, engine 12 includes a cooling system 40 having a coolant temperature sensor 42 in fluid communication therewith and electrically connected to a temperature input (TMP) of sensor offset compensation block 38 via signal path 44. Engine coolant temperature is generally believed to be the most stable and well understood fluid temperature of engine 12, and by thermally coupling the ΔP sensor 30 to the cooling system 40 and monitoring the coolant temperature sensor 42, the temperature of the ΔP sensor 30 may be accurately determined. In one embodiment, sensor 30 is thermally coupled to cooling system 40 via a suitable heat sink arrangement so that sensor 30 is at substantially the same temperature as the coolant fluid contained within cooling system 40. Alternatively, sensor 30 may be designed with a coolant passage therethrough such that coolant fluid from system 40 may be directed through sensor 30 to maintain it at substantially the same temperature as that of cooling system 40. In any case, the thermal coupling of sensor 30 to cooling system 40 is preferably made in such a manner that the operating temperature of sensor 30 is substantially the same as that of cooling system 40, and any known technique for accomplishing this goal is intended to fall within the scope of the present invention.

As an alternative to cooling system 40, the present invention contemplates thermally coupling sensor 30 either directly to the engine 12, wherein system 10 preferably includes an engine temperature sensor of known construction that is operable to provide sensor compensation block 38 with a temperature signal indicative of engine operating temperature. Alternatively still, the present invention contemplates thermally coupling sensor 30 to a structural component of engine 12 having an operating temperature that is either known of readily ascertainable. For example, sensor 30 may be thermally coupled to intake manifold 14, wherein manifold 14 typically includes an intake manifold temperature sensor operable to produce a signal indicative of intake manifold temperature. Alternatively, engine controller 28 may include a so-called "virtual" intake manifold temperature sensor in the form of a software algorithm that is operable to estimate the temperature of the intake manifold 14 as a function of other engine operating conditions. In either case, sensor 30 may be thermally coupled to, or disposed in fluid communications with, intake manifold 14 such that the operating temperature of sensor 30 is substantially the same as that of the intake manifold 14. As another example, system 10 may include a turbocharger (not shown) having a turbocharger compressor supplying fresh air from ambient to the intake manifold 14 as is known in the art. In this case, sensor 30 may be thermally coupled to an air outlet of the turbocharger compressor, in which case engine controller 28 may include a "virtual" compressor outlet temperature sensor in the form of a software algorithm that is operable to estimate a compressor outlet temperature based on other engine operating signals. In this case, sensor 30 is preferably thermally coupled to, or disposed in fluid communications with, the compressor outlet such that the operating temperature of sensor 30 is substantially the same as that of the turbocharger compressor outlet. It is to be understood, however, that while the intake manifold and/or turbocharger compressor outlet temperature sensors will generally produce temperature signals substantially indicative of the operating temperature of sensor 30 if coupled thereto, these temperatures may vary widely, and are therefore less preferred over operating temperatures that stabilize over a much narrower operating temperature range. Moreover, the actual operating temperature of sensor 30 may in some cases be significantly greater than that of the intake manifold 14 and/or turbocharger compressor outlet due to exposure of the sensor 30 to high temperature exhaust gases, and care must therefore be taken to ensure that the thermal coupling of sensor 30 to either the intake manifold or turbocharger compressor outlet is adequate to regulate the operating temperature of sensor 30 to that of its underlying structure.

Regardless of the location of sensor 30 in relation to any structural component of engine 12, the present invention contemplates that the operating temperature of sensor 30 may alternatively be determined by a temperature sensor 46 thermally coupled to sensor 30 and providing a corresponding temperature signal to the temperature input (TMP) of block 38 via signal path 48. In one embodiment, temperature sensor 46 is a thermocouple operable to produce a temperature signal indicative of the operating temperature of sensor 30, although the present invention contemplates using other known temperature sensors.

System 10 further includes a key switch 50 of known construction and electrically connected to a key switch input (K) of sensor offset compensation block 38 via signal path 52. Key switch 50, as is known in the art, includes an "off" position, an "on" position and a "crank" position, and signal path 52 preferably carries a signal indicative of the operational state of key switch 50 as just described.

Optionally, as will be described in further detail hereinafter, system 10 may include an ambient temperature sensor 54 that is electrically connected to an ambient temperature input (AT) of sensor offset compensation block 38 via signal path 56, as shown in phantom in FIG. 1. In operation, sensor 54 is operable to produce a temperature signal indicative of the ambient temperature about system 10. Engine controller 28 may optionally include a timer 62 connected to a timer input (T) of sensor offset compensation block 38. In operation, compensation block 38 may reset timer 62, and timer 62 is otherwise operable to provide compensation block 38 with a time signal indicative of an elapsed time since its most recent reset.

In the embodiment shown in FIG. 1, the flow restriction mechanism 24 is preferably an EGR valve of known construction, wherein sensor offset compensation block 38 includes an EGR output electrically connected to an EGR valve actuator 58 via signal path 60. In this embodiment, EGR valve 24 defines a variable cross-sectional flow area therethrough, and the sensor offset compensation block 38 is operable, as will be described in greater detail hereinafter, to control the position of EGR valve 24 to ensure that valve 24 is open during data gathering operation of the sensor offset compensation block 38. In an alternative embodiment, the flow restriction mechanism 24 may be a passive flow restriction mechanism defining a fixed cross-sectional flow area therethrough. In this case, the EGR output of sensor offset compensation block 38 may be omitted.

In accordance with another aspect of the present invention, the sensor offset compensation block 38 of engine controller 28 preferably includes a software algorithm for gathering data relating to the operation of sensor 30 for a number of operating temperature conditions under known zero ΔP conditions, for the purpose of defining the relationship between the sensor's offset voltage and the sensor's operating temperature. In one preferred embodiment, low temperature (at zero ΔP) data are gathered at key-on, prior to engine start up, and high temperature (at zero ΔP) data are gathered at key-off (engine shutdown), preferably after engine and turbocharger speed have reached zero.

For systems wherein ΔP is measured across an EGR valve 24 as illustrated in FIG. 1, the EGR valve 24 is preferably controlled by block 38 to a fully open position during the data gathering operations to ensure that the sensor voltage measurements are not corrupted by any residual pressures acting upon sensor 30 from either its fresh air side or its exhaust gas side. Opening the EGR valve 24 under data gathering operations reduces the impact of any such static pressures by allowing the pressure across the valve 24 to substantially equalize. In any case, at least cold start and hot shutdown data are preferably gathered over the life of the engine 12 to provide for continual temperature offset calibration of sensor 30 as well as for diagnostic trending purposes. In its simplest form, the sensor offset compensation block 38 of the present invention is operable to gather one cold (pre-start) temperature operational value for sensor 30 under zero ΔP conditions and one hot (post-shutdown) temperature operational value for sensor 30 under zero ΔP conditions, and to establish a linear relationship therebetween defining the offset signal behavior of sensor 30 as a function of its operating temperature. Alternatively, additional operational values for sensor 30 under zero ΔP conditions may be gathered as the sensor 30 cools following engine shutdown to thereby allow more accurate modeling of the offset signal behavior of sensor 30 as a function of its operating temperature.

In one embodiment of engine controller 28, the sensor offset compensation block 38 includes a model of the differential pressure across flow restriction mechanism 24, wherein the model preferably includes a temperature-dependent offset term and a substantially temperature-independent gain or sensitivity term. In one embodiment, the ΔP model stored in memory 64 is preferably defined by a transfer function of the form:

$$\Delta P=[a+b\times T_{\Delta P}]+c\times\Delta PV,$$

where,

ΔP is the true differential pressure across flow restriction mechanism 24,

"a" is a constant defining a base pressure offset (in psid),

"b" is a constant defining an offset temperature gain (in psid/°F.), $T_{\Delta P}$ is the temperature of the ΔP sensor 30 (in °F.), c is a constant defining a mean pressure gain (in psid/VDC), and ΔPV is the operating voltage produced by ΔP sensor 30.

The sensor offset compensation block 38 is operable, in accordance with the present invention, to continually compute at least some of the constants in the foregoing ΔP transfer function based on readings of the sensor voltage and sensor temperature. Preferably, the transfer function constants are computed as a function of such readings taken at different temperatures under operating conditions wherein it is known that ΔP=0 (e.g., when engine 12 is not running). As described briefly hereinabove, the sensor offset compensation block 38 is preferably responsive to transitions of the key switch 50 between "off" and "on" positions to conduct voltage and temperature measurements for sensor 30. In one embodiment, "c" is a predetermined mean population pressure gain constant stored in memory 64 and based on an established sensor population mean, and constants "a" and "b" are determined by taking measurements under cold; i.e., engine pre-start, conditions and "hot"; i.e., engine shutdown, conditions. In this embodiment, constants "a" and "b" may therefore be determined by solving the transfer function under 0 ΔP conditions at the two temperature extremes which yields the equations:

$$b=c(V_C-V_H)/(T_H-T_C)$$

and, $$a=-c\times V_C-b\times T_C,$$

where, $V_C$ is the (cold) signal voltage produced by ΔP sensor 30 when the key switch 50 transitions from the "off" to the "on" position (e.g., engine pre-start), $V_H$ is the (hot) voltage signal produced by ΔP sensor 30 when key switch 50 transitions from its "on" to its "off" state (e.g., at engine shutdown), $T_H$ is the (hot) temperature of the ΔP sensor 30 when the key switch 50 transitions from its "on" state to its "off" state, and $T_C$ is the (cold) temperature of the ΔP sensor 30 when the key switch 50 transitions from its "off" state to its "on" state.

It will be noted that the foregoing equations define the offset term of the ΔP transfer function as a linear function of temperature, although the present invention contemplates embodiments of the sensor offset compensation block 38 wherein a number of additional voltage/temperature readings may be made after the engine 12 has been shut down and as the temperature of the ΔP sensor 30 ramps down from its hot operating temperature (e.g., engine coolant temperature) to ambient. Moreover, the sensor offset compensation block 38 is preferably only operational after extended non-operational periods of engine 12 so as to ensure reasonably isothermal conditions between the ΔP sensor 30 and the sensor producing the signal indicative of the operating temperature of the ΔP sensor 30.

Figure 2:
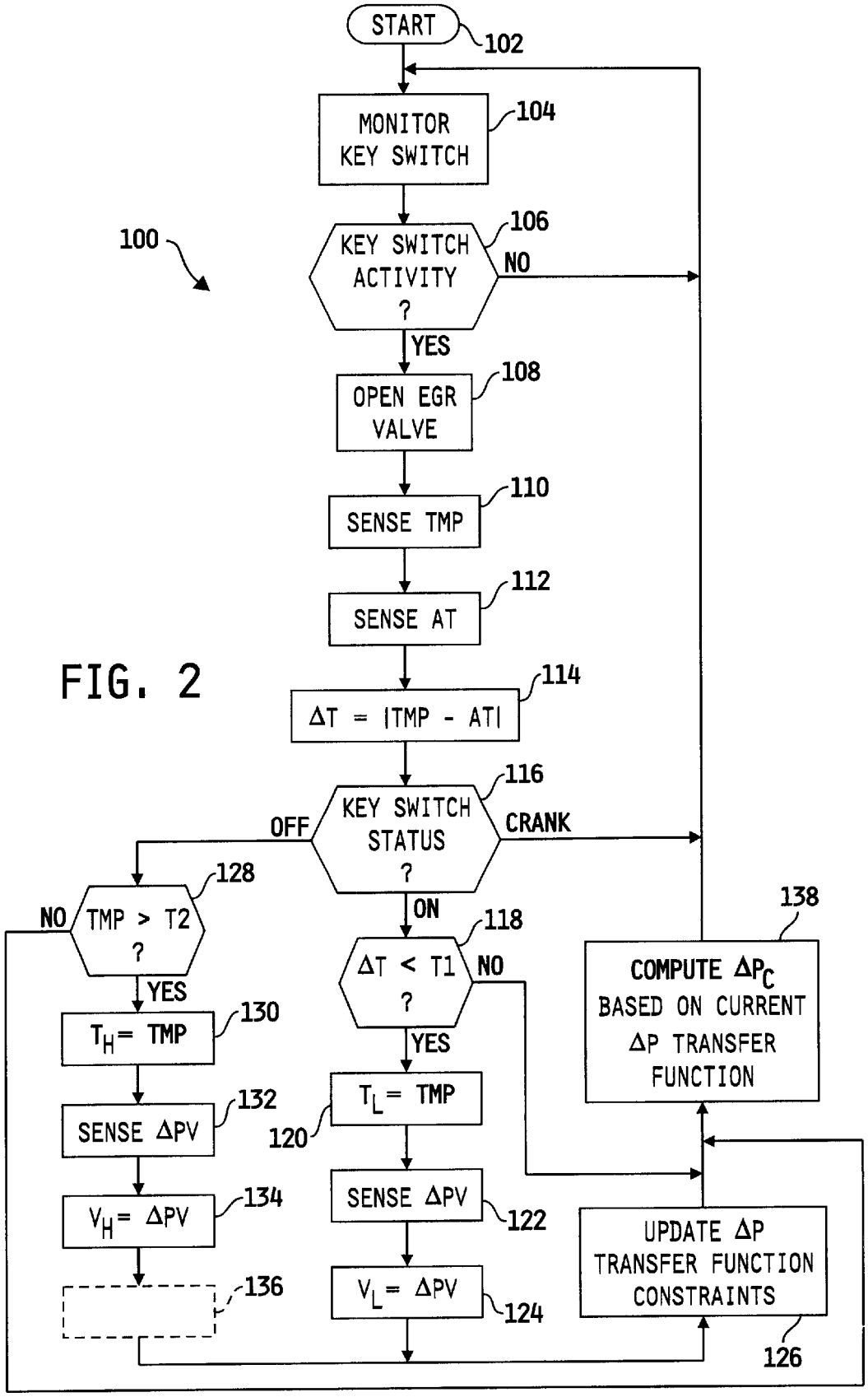
FIG. 2 is a flowchart illustrating one preferred embodiment of a software algorithm for adaptively updating a sensor transfer function, in accordance with the present invention.

Referring now to FIG. 2, a flowchart is shown illustrating one preferred embodiment of a software algorithm 100 for adaptively updating the sensor transfer function described hereinabove. Algorithm 100 is preferably stored within the memory unit 64 of engine controller 28, and is executed by the engine controller 28 to update the constants of the ΔP sensor transfer function as described above. Preferably, constants "a" and "b" are initially (i.e., when the engine is new and/or when engine controller 28 is newly calibrated) preset to reasonable values therefore, and are updated at each transition of key switch 50 as will be described in greater detail hereinafter.

Algorithm 100 begins at step 102, and at step 104 engine controller 28 is operable to monitor the key switch 50. Thereafter at step 106, if engine controller 28 determines that the key switch 50 has been activated, algorithm execution advances to step 108. Otherwise, algorithm 100 loops back to step 104. If, at step 106, engine controller 28 determines that the key switch 50 has been activated, engine controller 28 is operable at step 108 to open the EGR valve if the EGR flow restriction mechanism 24 is embodied as an EGR valve. If the EGR flow restriction mechanism 24 is instead embodied as a fixed cross-sectional flow area mechanism, step 108 may be omitted. In any case, algorithm execution continues at step 110 where engine controller 28 is operable to sense the temperature of the ΔP sensor 30 using any of the techniques discussed hereinabove with respect to FIG. 1. Thereafter at step 112, engine controller 28 is operable to sense ambient temperature, preferably via ambient temperature sensor 54. Following step 112, algorithm execution advances to step 114 where controller 28 is operable to determine a temperature difference ΔT as an absolute value of the difference between the sensor temperature value determined at step 110 and the ambient temperature value determined at step 112.

Following step 114, engine controller 28 is operable at step 116 to determine the state of the key switch resulting from the key switch activity detected at step 106. If the key switch activity detected at step 106 corresponded to a switch from its "on" position to its crank position, algorithm execution loops back to step 104. If engine controller 28 determines at step 116 that the key switch 50 has switched from its "off" position to its "on" position, this corresponds to an engine pre-start condition and engine controller 28 is operable thereafter at step 118 to compare the ΔT value determined at step 114 with a temperature threshold value T1. If, at step 118, engine controller 28 determines that ΔT is less than T1, algorithm execution advances to step 120 where engine controller 28 is operable to set a low temperature term ($T_L$) to the sensor temperature value TMP determined at step 110. Thereafter at step 122, engine controller 28 is operable to determine the current operating voltage (ΔPV) of the ΔP sensor 30 and to set a low temperature voltage value ($V_L$) to the ΔPV value at step 122.

If, at step 116, engine controller 28 determines that the key switch activity detected at step 106 corresponds to a switch of the key position from its "on" position to its "off" position, algorithm execution advances to step 128 where engine controller 28 is operable to compare the sensor temperature value (TMP) determined at step 110 with another temperature threshold value T2. If engine controller 28 determines that the sensor temperature value TMP is greater than T2, algorithm execution advances to step 130 where engine controller 28 is operable to set a high temperature value ($T_H$) to the temperature value TMP of the sensor determined at step 110. Thereafter at step 132, engine controller 28 is operable to sense the operating voltage (ΔPV) of the ΔP sensor 30, and thereafter at step 134 to set a high temperature voltage value ($V_H$) to the ΔPV value. Algorithm 100 may optionally include a step 136 wherein engine controller 28 may be operable to gather additional temperature and voltage information relating to the ΔP sensor 30 as it cools following engine shutdown, and details of one preferred embodiment of step 136 will be described hereinafter with respect to FIG. 4. In any case, algorithm execution advances from step 124 or step 136 to step 126 where engine controller 28 is operable to update the values of the ΔP transfer function constants.

In one embodiment, wherein engine controller 28 is operable to determine the ΔP transfer function constants based on two temperature extremes $T_L$ and $T_H$, engine controller 28 is preferably operable at step 126 to update the ΔP transfer function constants "a" and "b" based on an application of the equations described hereinabove. It should be apparent that in this embodiment, any single traversal of algorithm 100 produces only a single "set" of sensor temperature and sensor voltage data; i.e., either $T_H$ and $V_H$ or $T_L$ and $V_L$. In this case, engine controller 28 is preferably operable to update constants "a" and "b" using the sensor temperature and voltage values just obtained along with most recent values of the opposite sensor and temperature and voltage values. In this manner, the transfer function constants "a" and "b" will reflect operating conditions including those relating to the most recent key switch transition.

In an alternate embodiment, wherein the engine controller 28 is operable to determine the ΔP transfer function constants based on sensor voltage and temperature information at more than two operating temperatures, engine controller 28 is preferably operable at step 126 to update the ΔP transfer function constants based on any known data fitting technique such, for example, known least squares methods. As with the previous embodiment, engine controller 28 is preferably operable to update constants "a", "b" and "c") using the sensor temperature and voltage values just obtained along with most recent values of the opposite sensor and temperature and voltage values. In this manner, the transfer function constants "a", "b" and "c" will reflect operating conditions including those relating to the most recent key switch transition.

Step 126, as well as the "no" branches of steps 116 and 128, advance to step 138 where engine controller 28 is operable to compute a compensated ΔP value ($\Delta P_C$) as a function of the current ΔP transfer function. Algorithm execution advances from step 138 to step 104.

It should be apparent that algorithm 100 illustrated and described with respect to FIG. 2 is operable to measure both the operating temperature of sensor 30 and the output voltage produced by sensor 30 after the engine is turned off and prior to engine start up. In order to ensure that the engine has been running sufficiently long to bring the engine temperature (and hence the engine coolant temperature) up to a typical operating temperature prior to measuring "hot" data, step 128 is included to compare the sensor temperature TMP to a temperature threshold T2. Preferably, T2 is set to a temperature above which is considered a normal operating temperature of engine 12, and "hot" data relating to sensor 30 is only gathered if TMP is above T2. Likewise, it is preferable to ensure that the engine 12 has cooled sufficiently following shutdown to allow the temperature to decay to ambient temperature prior to measuring "cold" data. Steps 112, 114 and 118 are included to accomplish this goal wherein ΔT represents the difference between the current sensor temperature TMP and the current ambient temperature AT, and wherein T1 is a temperature threshold below which TMP is considered to be sufficiently close to AT to allow the gathering of "cold" data. Those skilled in the art will recognize that the numerical values of T1 and T2 are a matter of design choice, and any values selected for T1 and T2 are intended to fall within the scope of the present invention.

Figure 3:
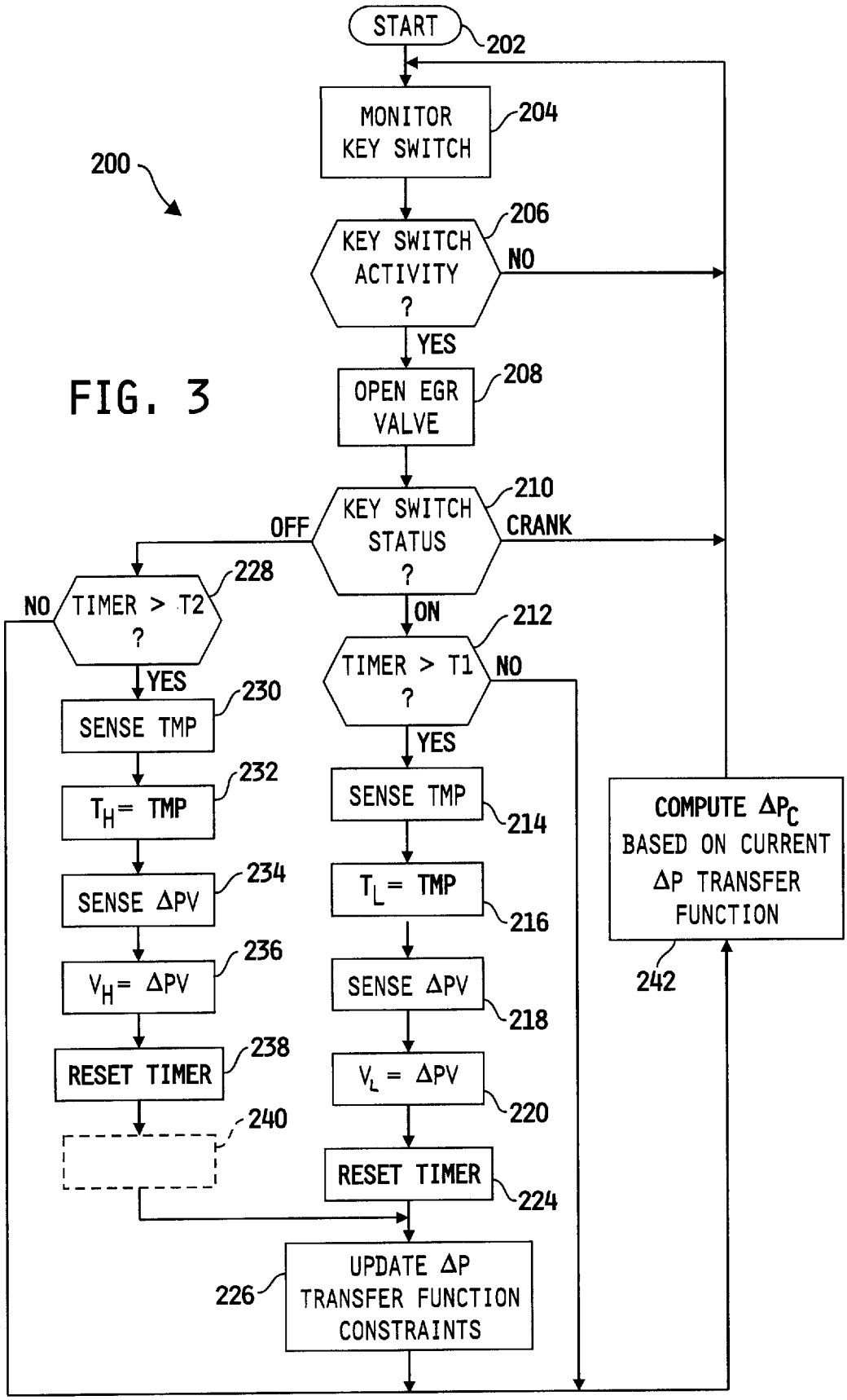
FIG. 3 is a flowchart illustrating an alternate embodiment of a software algorithm for adaptively updating a sensor transfer function, in accordance with the present invention.

Referring now to FIG. 3, a flowchart is shown illustrating an alternate embodiment of a software algorithm 200 for adaptively updating the sensor transfer function described hereinabove. Algorithm 200 is preferably stored within the memory unit 64 of engine controller 28, and is executed by the engine controller 28 to update the constants of the ΔP sensor transfer function as described hereinabove. As with algorithm 100, algorithm 200 preferably requires constants "a" and "b" to be initially (i.e., when the engine is new and/or when engine controller 28 is newly calibrated) preset to reasonable values therefore, and are thereafter updated at each on/off transition of key switch 50 as will be described in greater detail hereinafter.

Algorithm 200 begins at step 202, and at step 204 engine controller 28 is operable to monitor the key switch 50. Thereafter at step 206, if engine controller 28 determines that the key switch 50 has been activated, algorithm execution advances to step 208. Otherwise, algorithm 200 loops back to step 204. If, at step 206, engine controller 28 determines that the key switch 50 has been activated, engine controller 28 is operable at step 208 to open the EGR valve if the EGR flow restriction mechanism 24 is embodied as an EGR valve. If the EGR flow restriction mechanism 24 is instead embodied as a fixed cross-sectional flow area mechanism, step 208 may be omitted. In any case, algorithm execution continues at step 210 where engine controller 28 is operable to determine the state of the key switch resulting from the key switch activity detected at step 206. If the key switch activity detected at step 206 corresponds to a switch from its "on" position to its crank position, algorithm execution loops back to step 204.

If engine controller 28 determines at step 210 that the key switch 50 has switched from its "off" position to its "on" position, this corresponds to an engine pre-start condition and engine controller 28 is operable thereafter at step 212 to compare a time value (TIMER) of timer 62 (FIG. 1) to a predefined time value T1. If engine controller 28 determines that TIMER is greater than T1, algorithm execution advances to step 214 where engine controller 28 is operable to determine an operating temperature (TMP) of sensor 30 using any one or more of the techniques described hereinabove with respect to FIG. 1. Thereafter at step 216, engine controller 28 is operable to set a low temperature term ($T_L$) to the sensor temperature value TMP determined at step 214. Thereafter at step 218, engine controller 28 is operable to determine the current operating voltage (ΔPV) of the ΔP sensor 30, and to set a low temperature voltage value ($V_L$) to the ΔPV value at step 220. Following step 220, algorithm execution advances to step 224 where engine controller 28 is operable to reset the timer 62 to a default value; e.g., zero.

If, at step 210, engine controller 28 determines that the key switch activity detected at step 206 corresponds to a switch of the key position from its "on" position to its "off" position, algorithm execution advances to step 228 where engine controller 28 is operable to compare the time value (TIMER) of timer 62 to a second predefined time threshold T2. If engine controller 28 determines that TIMER is greater than T2, algorithm execution advances to step 230 where engine controller 28 is operable to determine an operating temperature (TMP) of sensor 30 using any one or more of the techniques described hereinabove with respect to FIG. 1. Thereafter at step 232, engine controller 28 is operable to set a high temperature term ($T_H$) to the sensor temperature value TMP determined at step 230. Thereafter at step 234, engine controller 28 is operable to determine the current operating voltage (ΔPV) of the ΔP sensor 30, and to set a high temperature voltage value ($V_H$) to the ΔPV value at step 236. Following step 236, algorithm execution advances to step 238 where engine controller 28 is operable to reset the timer 62 to its default value; e.g., zero.

Algorithm 200 may optionally include a step 240 wherein engine controller 28 may be operable to gather additional temperature and voltage information relating to the ΔP sensor 30 as it cools following engine shutdown, and details of one preferred embodiment of step 240 will be described hereinafter with respect to FIG. 4. In any case, algorithm execution advances from step 224 or step 240 to step 226 where engine controller 28 is operable to update the values of the ΔP transfer function constants.

In one embodiment, wherein engine controller 28 is operable to determine the ΔP transfer function constants based on two temperature extremes $T_L$ and $T_H$, engine controller 28 is preferably operable at step 226 to update the ΔP transfer function constants "a" and "b" based on an application of the equations described hereinabove. It should be apparent that in this embodiment, any single traversal of algorithm 200 produces only a single "set" of sensor temperature and sensor voltage data; i.e., either $T_H$ and $V_H$ or $T_L$ and $V_L$. In this case, engine controller 28 is preferably operable to update constants "a" and "b" using the sensor temperature and voltage values just obtained along with most recent values of the opposite sensor and temperature and voltage values. In this manner, the transfer function constants "a" and "b" will reflect operating conditions including those relating to the most recent key switch transition.

In an alternate embodiment, wherein the engine controller 28 is operable to determine the ΔP transfer function constants based on sensor voltage and temperature information at more than two operating temperatures, engine controller 28 is preferably operable at step 226 to update the ΔP transfer function constants (optionally including constant "c") based on any known data fitting technique such, for example, known least squares methods. As with the previous embodiment, engine controller 28 is preferably operable to update constants "a", "b" and "c") using the sensor temperature and voltage values just obtained along with most recent values of the opposite sensor and temperature and voltage values. In this manner, the transfer function constants "a", "b" and "c" will reflect operating conditions including those relating to the most recent key switch transition.

Step 226, as well as the "no" branches of steps 212 and 228, advance to step 242 where engine controller 28 is operable to compute a compensated ΔP value ($\Delta P_C$) as a function of the current ΔP transfer function. Algorithm execution advances from step 242 back to step 104.

It should be apparent that, like algorithm 100, algorithm 200 illustrated and described with respect to FIG. 3 is operable to measure both the operating temperature of sensor 30 and the output voltage produced by sensor 30 after the engine is turned off and prior to engine start up. However, in order to ensure that the engine has been running sufficiently long to bring the engine temperature (and hence the engine coolant temperature) up to a typical operating temperature prior to measuring "hot" data, step 228 is included to compare the time value (TIMER) of timer 62 to a timer threshold T2. Preferably, T2 is set to a time value above which is considered a sufficient time for engine 12 to reach a normal operating temperature, and "hot" data relating to sensor 30 is only gathered if TIMER is above T2. Likewise, it is preferable to ensure that the engine 12 has cooled sufficiently following shutdown to allow the temperature to decay to ambient temperature prior to measuring "cold" data. Step 212 is included to accomplish this goal wherein T1 represents a time value above which is considered a sufficient time for engine 12 to cool to near ambient temperature, and "cold" data relating to sensor 30 is only gathered if TIMER is above T1. Those skilled in the art will recognize that the numerical values of T1 and T2 are a matter of design choice, and any values selected for T1 and T2 are intended to fall within the scope of the present invention.

Figure 4:
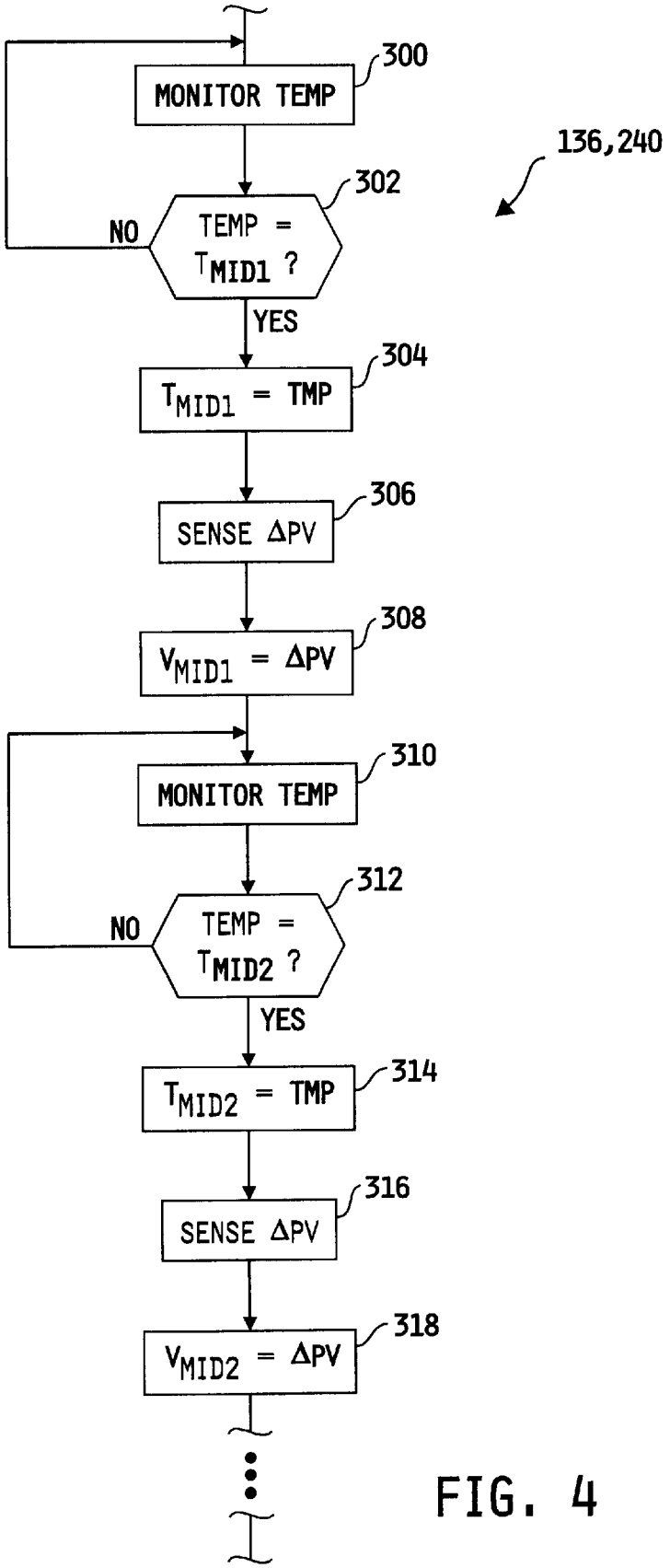
FIG. 4 is a flowchart illustrating one preferred embodiment of a software algorithm for executing the routine illustrated in the dashed-line blocks of the algorithms of FIGS. 2 and 3.

Referring now to FIG. 4, one preferred embodiment of a software routine for executing step 136 of algorithm 100 or step 240 of algorithm 200, in accordance with the present invention, is shown. The software routine begins at step 300 wherein engine controller 28 is operable to monitor the operating temperature (TMP) of sensor 30 using any of the techniques described hereinabove. Thereafter at step 302, engine controller 28 is operable to compare the sensor operating temperature value TMP with a first mid-temperature value $T_{MID1}$, wherein $T_{MID1}$ represents a temperature between low temperature $T_L$ and high temperature $T_H$. As long as TMP is not equal to $T_{MID1}$, step 302 loops back to step 300. However, as the operating temperature of sensor 30 slowly cools, its temperature TMP will eventually reach $T_{MID1}$, and when it does algorithm execution advances to step 304 where engine controller 28 is operable to set a first mid-temperature term ($T_{MID1}$) to the sensor temperature value TMP determined at step 300. Thereafter at step 306, engine controller 28 is operable to determine the current operating voltage (ΔPV) of the ΔP sensor 30, and to set a first mid-temperature voltage value ($V_{MID1}$) to the ΔPV value at step 308. Following step 308, the software routine illustrated in FIG. 4 may include steps 310–318 that are identical to steps 300–308 except that they are configured for gathering sensor operating temperature and sensor operating voltage at a second mid-temperature value $T_{MID2}$, wherein $T_{MID2}<T_{MID1}$. Thus, as the operating temperature of sensor 30 cools below $T_{MID1}$, it will eventually reach $T_{MID2}$ wherein engine controller 28 may optionally be operable to gather operating information relating to sensor 30. In fact, the present invention contemplates that the software routine illustrated in FIG. 4 may include any desired number of sets of steps 310–318 for gathering operational information relating to sensor 30 at a corresponding number of temperature values between $T_H$ and $T_L$. Either of algorithms 100 and 200 may then use this additional information in a known manner to provide a more accurate definition of the sensor model offset term.

Figure 5:
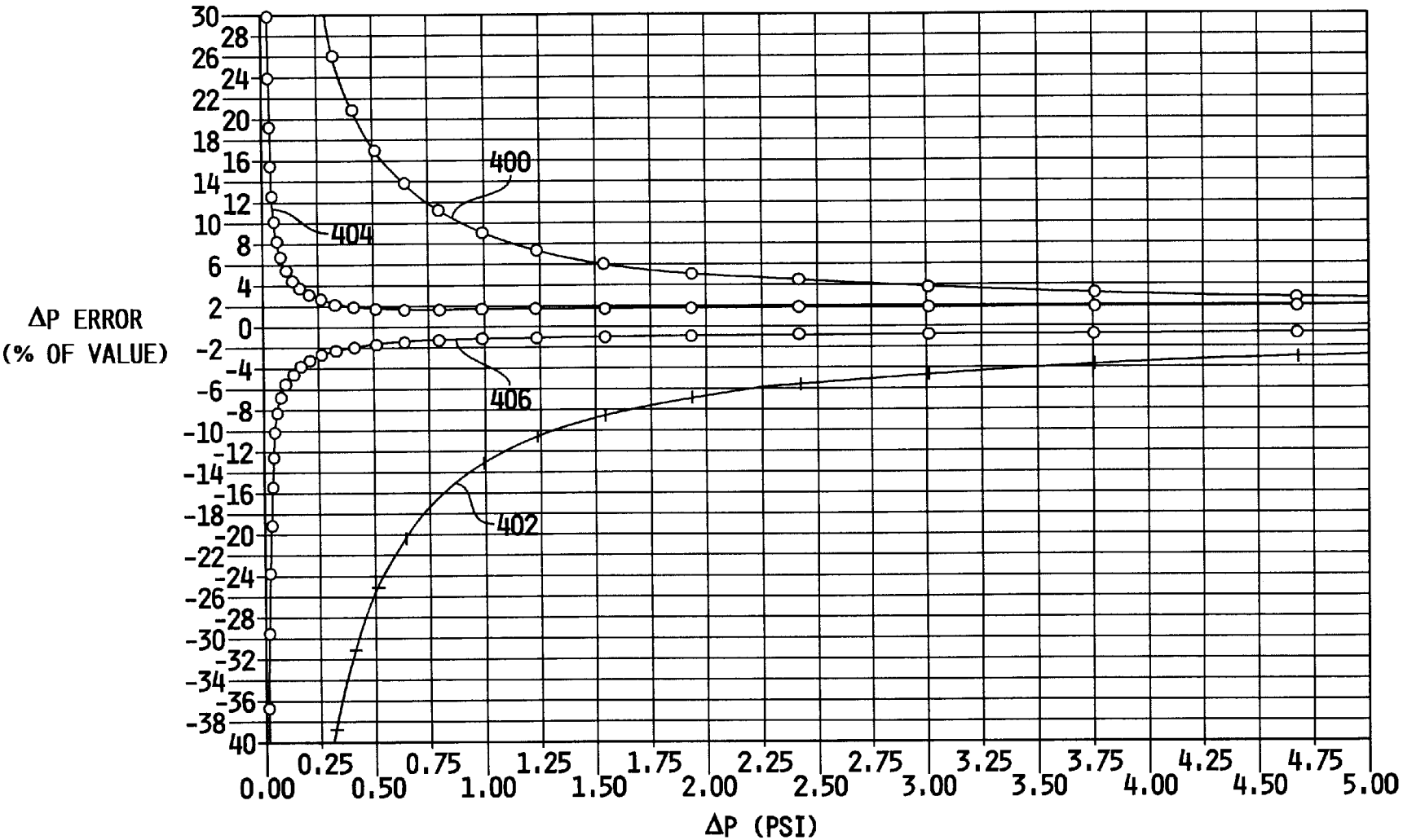
FIG. 5 is a plot of ΔP sensor error vs. ΔP signal value illustrating performance benefits of the present invention with a ΔP sensor over those of conventional ΔP sensors signal processing techniques.

Referring now to FIG. 5, a plot of ΔP error (in % of value) vs. ΔP value (in psid) is shown comparing results of conventional ΔP measuring techniques with that of the present invention over a temperature range of −40° C. to 125° C. Curves 400 and 402 represent the maximum and minimum error envelopes respectively of the conventional ΔP measuring technique over a range of ΔP from 0.0 to 5.0 psid. In comparison, curves 404 and 406 represent the maximum and minimum error envelopes respectively of the ΔP measuring technique of the present invention over the same ΔP pressure range. Inspection of FIG. 5 reveals that the concepts of the present invention yield a substantial increase in accuracy over conventional ΔP measurement techniques. While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A temperature compensation system for minimizing sensor offset variations, comprising:

a sensor producing a sensor signal indicative of an operating condition of an internal combustion engine;

means for determining a temperature of said sensor and producing a temperature signal corresponding thereto;

a key switch for starting and stopping said engine, said key switch having at least an on position and an off position; and an engine controller responsive to a transition of said key switch to said on position to determine a first temperature signal value and an associated first sensor signal value, said controller responsive to a transition of said key switch to said off position to determine a second temperature signal value and an associated second sensor signal value, said controller defining an offset value associated with said sensor as a function of said first and second temperature signal values and of said first and second sensor signal values.

2. The system of claim 1 further including:

an intake manifold coupled to said engine;

an exhaust manifold coupled to said engine and configured to expel engine exhaust gas therefrom;

a conduit having one end fluidly coupled to said exhaust manifold and an opposite end fluidly coupled to said intake manifold, said conduit configured to supply engine exhaust gas from said exhaust manifold to said intake manifold; and a flow restriction mechanism disposed in line with said conduit;

wherein said sensor is a differential pressure sensor producing a differential pressure signal indicative of a pressure difference across said flow restriction mechanism.

3. The system of claim 2 wherein said flow restriction mechanism is an exhaust gas recirculation valve defining a variable cross-sectional flow area therethrough.

4. The system of claim 2 wherein said flow restriction mechanism defines a fixed cross-sectional flow area therethrough.

5. The system of claim 2 wherein said differential pressure sensor is thermally coupled to a structural component of said engine such that an operating temperature of said differential pressure sensor is substantially identical to an operating temperature of said structural component of said engine;

and wherein said means for determining a temperature of said sensor is a temperature sensor producing said temperature signal, said temperature signal indicative of said operating temperature of said structural component of said engine.

6. The system of claim 5 wherein said structural component of said engine is an engine cooling system;

and wherein said temperature signal produced by said temperature sensor corresponds to a coolant temperature of said cooling system.

7. The system of claim 1 wherein said sensor is thermally coupled to a structural component of said engine such that an operating temperature of said sensor is substantially identical to an operating temperature of said structural component of said engine;

and wherein said means for determining a temperature of said sensor is a temperature sensor producing said temperature signal, said temperature signal indicative of said operating temperature of said structural component of said engine.

8. The system of claim 7 wherein said engine includes a cooling system;

and wherein said temperature signal produced by said temperature sensor corresponds to a coolant temperature of said cooling system.

9. The system of claim 1 wherein said engine controller is further responsive to a transition of said key switch to either of said off and said on positions to determine a third temperature signal value and an associated third sensor signal value, said controller defining said offset value further as a function of said third temperature signal value and said third sensor signal value.

10. The system of claim 1 further including a memory having stored therein a model of said operating condition of said engine, said model defining a temperature dependent offset term corresponding to said offset value associated with said sensor and a gain term.

11. The system of claim 10 wherein said engine controller is responsive to said sensor signal to determine a value of said operating condition based on said model.

12. A temperature compensation system for minimizing sensor offset variations, comprising:

a sensor producing a sensor signal indicative of an operating condition of an internal combustion engine;

a memory having stored therein a model of said operating condition, said model defining a temperature dependent offset term;

means for determining a temperature of said sensor and producing a temperature signal corresponding thereto;

a key switch for starting and stopping said engine, said key switch having at least an on position and an off position; and an engine controller monitoring said key switch, said controller responsive to said temperature signal and said sensor signal to determine a first temperature and a first signal value associated with said sensor if said key switch switches to either of said off and on positions, said controller updating said temperature dependent offset term based on said first temperature and said first signal value.

13. The system of claim 12 wherein said model further includes a gain term, said engine controller responsive to said sensor signal to determine a value of said operating condition based on said model.

14. The system of claim 12 wherein said controller is responsive to said temperature signal and said sensor signal to determine a second temperature and a second signal value associated with said sensor if said key switch switches to the other of said off and on positions, said controller updating said temperature dependent offset term based further on said second temperature and said second signal value.

15. The system of claim 12 wherein said sensor is thermally coupled to a structural component of said engine such that an operating temperature of said sensor is substantially identical to an operating temperature of said structural component of said engine;

and wherein said means for determining a temperature of said sensor is a temperature sensor producing said temperature signal, said temperature signal indicative of said operating temperature of said structural component of said engine.

16. The system of claim 14 wherein said sensor is thermally coupled to said engine such that said operating temperature of said sensor is substantially identical to an operating temperature of said engine.

17. The system of claim 15 further wherein said engine further includes a cooling system;

and wherein said sensor is thermally coupled to said engine via said cooling system such that an operating temperature of said cooling system is substantially identical to an operating temperature of said sensor.

18. The system of claim 16 wherein said temperature sensor is a coolant temperature sensor producing a coolant temperature signal indicative of said operating temperature of said cooling system.

19. The system of claim 17 wherein said sensor is a differential pressure sensor producing a differential pressure signal indicative of a pressure difference between an exhaust manifold and an intake manifold of said engine.

20. The system of claim 12 further including:

an intake manifold coupled to said engine;

an exhaust manifold coupled to said engine and configured to expel engine exhaust gas therefrom;

a conduit having one end fluidly coupled to said exhaust manifold and an opposite end fluidly coupled to said intake manifold, said conduit configured to supply engine exhaust gas from said exhaust manifold to said intake manifold; and a flow restriction mechanism disposed in line with said conduit;

wherein said sensor is a differential pressure sensor producing a differential pressure signal indicative of a pressure difference across said flow restriction mechanism.

21. The system of claim 19 wherein said flow restriction mechanism is an exhaust gas recirculation valve defining a variable cross-sectional flow area therethrough.

22. The system of claim 19 wherein said flow restriction mechanism defines a fixed cross-sectional flow area therethrough.

23. A temperature compensation method of minimizing sensor offset variations, the method comprising the steps of:

sensing an operating condition of an internal combustion engine with an engine operating condition sensor;

computing a value of said engine operating condition based on a model defining a response of said engine operating condition sensor, said model including a temperature dependent offset term;

monitoring a key switch for starting and stopping said engine;

determining a first operating temperature of said engine operating condition sensor and an associated first sensor value if said key switch switches to either of an off and an on position thereof; and updating said offset term of said model based on said first operating temperature and said first sensor value.

24. The method of claim 22 further including the step of determining a second operating temperature of said engine operating condition sensor and an associated second sensor value if said key switch switches to the other of an off and on position thereof;

and wherein the updating step includes updating said offset term of said model based further on said second operating temperature and said second sensor value.

25. The method of claim 22 further including the following steps if a detected switching of said key switch corresponds to a switch to said off position:

comparing said first operating temperature to a temperature threshold; and executing said updating step only if said first operating temperature is above said temperature threshold.

26. The method of claim 22 further including the following steps if a detected switching of said key switch corresponds to a switch to said on position:

determining ambient temperature;

executing said updating step only if said first operating temperature is within a predefined temperature range of said ambient temperature.

27. The method of claim 22 including the following steps if a detected switching of said key switch corresponds to a switch to said on position:

sensing an elapsed time value of a timer; and executing said updating step only if said elapsed time value is above a threshold time value corresponding to a predefined elapsed time since said key switch switched to said off position.

28. The method of claim 22 wherein said engine operating condition corresponds to a pressure difference across a flow restriction mechanism disposed between an exhaust manifold of said engine and an intake manifold of said engine.

* * * * *